US005335383A

United States Patent [19]

Schwind

[11] Patent Number: 5,335,383

[45] Date of Patent: Aug. 9, 1994

[54] REMOVABLY ATTACHABLE FLAT SHEET-SKIRTING COMBINATION

[76] Inventor: Wilma M. Schwind, 636 Apple Ave., Toledo, Ohio 43609-1742

[21] Appl. No.: 92,988

[22] Filed: Jul. 19, 1993

[51] Int. Cl.[5] ..... A47G 21/00

[52] U.S. Cl. ..... 5/493; 5/482

[58] Field of Search ..... 5/482, 493, 451, 460, 5/922, 907

[56] References Cited

U.S. PATENT DOCUMENTS

| | | | |
|---|---|---|---|
| 2,619,658 | 12/1952 | Weinberg | 5/493 |
| 2,763,875 | 9/1956 | Piontkowski | 5/493 |
| 3,530,487 | 9/1970 | Beer | 5/496 |
| 4,587,683 | 5/1986 | Gardiner | 5/493 |
| 5,027,453 | 7/1991 | Koenig | 5/451 X |
| 5,086,531 | 2/1992 | Carlos | 5/493 |
| 5,205,003 | 4/1993 | Green | 5/493 |
| 5,231,716 | 8/1993 | Johenning | 5/907 X |

*Primary Examiner*—Michael F. Trettel
*Attorney, Agent, or Firm*—Robert E. Witt

[57] ABSTRACT

A removably attachable flat sheet-skirting combination is disclosed for use on conventional beds and waterbeds, which makes it possible for such skirting to be quickly and easily attached to and/or removed from a flat sheet without having to wrestle with a mattress on a conventional bed or a water-filled bladder on a waterbed, comprising a flat sheeting material having a first fastening material attached to a surface thereof at its periphery and such flat sheeting being preferably substantially permanently juxtaposed between a box-spring and a mattress, and further comprising a skirting material of continuous length or discontinuous lengths having a second fastening material attached to a surface thereof at its periphery, whereby upon alignment of such skirting material to such flat sheeting material at such peripheries, the first and second fastening materials are positioned for adhering interaction to attach such skirting material onto said flat sheeting material, and whereby upon pulling or tugging of such skirting material away from such flat sheeting material, the skirting material is easily removable.

27 Claims, 3 Drawing Sheets

REMOVABLY ATTACHABLE FLAT SHEET-SKIRTING COMBINATION

BACKGROUND OF THE INVENTION

This invention relates to a combination of elements which enables users of bedding materials to accessorize and/or to decorate beds with more flexibility, ease and quickness, and less physical effort, than heretofore possible, particularly when used by the elderly, the very young or physically impaired persons.

More specifically, this invention relates to a removably attachable flat sheeting and skirting combination for use primarily with conventional beds and waterbeds, which sheeting and skirting combination is easily and quickly capable of assembly and disassembly. Thereby, once the flat sheet is placed into position, generally between a box spring and a mattress of a conventional bed, or between a flatboard and a water bladder of a waterbed, it remains in place for reception of a skirting material, that is, it remains dimensionally stable during use, and changes of the skirting material can be easily and quickly made without disrupting the position of the flat sheet, and without having to wrestle or grapple with the mattress, or the bladder.

Heretofore, it has been common practice, at home and in commercial settings, such as hotels, motels and the like, to employ a skirting material which is permanently attached by conventional means, such as sewing or bonding, to a flat sheet. Use of such permanently attached skirting materials requires one or more persons to wrestle with the mattress of a conventional bed or to remove the mattress in order to properly place and align the flat sheet and the permanently attached skirting material and then to adjust the mattress or to replace the mattress. Then, when it was desired to clean or to change the bed skirting, again, one or more persons had to wrestle with or remove the mattress while removing the skirting and flat sheet combination. And, generally with waterbeds, accessorizing with skirting materials has been overlooked, most probably due to their design and construction.

There are problems with the use of permanently attached skirting-flat sheet combinations on conventional beds, most notable being the effort required and/or expended to install and to change the same. The mattress is not only cumbersome to deal with, but the effort involved can be tiring and potentially injurious to those doing the installing and the changing of the same, including back, arm and shoulder strain, and the effort involved requires strength, endurance and the assistance of another, especially in commercial settings where many beds are present. There are additional problems with the use of permanently attached flat sheet-skirting combinations on waterbeds, most notable being the great weight of a water-filled bladder and/or the inconvenience and expense of emptying and refilling the bladder and other construction limitations inherent with their construction, when it is desired to install or change the same.

Skirting or dust cover accessories for conventional beds have been available for a long period of time, but such skirting or dust cover was permanently attached to a flat sheet, which flat sheet had to be positioned between a mattress and a box spring, both of which are supported by a frame structure, and the permanently attached flat sheet-skirting/dust cover combination requires considerable effort, dexterity and strength to position the flat sheet and to adjust the drape of the skirting/dust cover.

However, skirting or dust cover accessories for waterbeds have generally been unavailable, but of some attempts to employ a skirting/dust cover on waterbeds, direct attachment to the structural elements of the waterbed were tried in lieu of the permanently attached Flat sheet-skirting/dust cover combination, due most likely to the combination of non-conventional structural elements which typically comprise a platform or kickboard, a flatboard which rests upon the platform/kickboard, and a frame attached to the flatboard to contain a bladder filled with water, which bladder rests upon the flatboard.

Many times, once a permanently attached skirting-flat sheet combination was positioned in place between a box-spring and a mattress of a conventional bed, it stayed there on a rather permanent basis due to the effort and the inconvenience involved to make a change, resulting in soiled, frayed and outdated fabrics, patterns and colors being displayed. Generally, as stated above, permanently attached flat sheet-skirting combinations were not made available for use on waterbeds due to construction limitations thereof. The only means seen, regarding the use of a skirting on a waterbed, was a direct attachment of the skirting to the base of the waterbed, via glue, staples and other means, which become undesirable with use, due its inconvenient and non-aesthetic location of attachment and due to it being disturbed with use and/or due to separation of the glue and staples from the skirting or the base, causing sagging and disattachment and uneven drape of the skirting, not readily corrected by the consumer.

Up to the present time, the only means for installing, changing or removing permanently attached flat sheet-skirting combinations on conventional beds was to grapple with or to remove the mattress and to employ extra workers in commercial settings, and this was without substantial flexibility regarding accessorizing beds relative to the fabrics, colors and patterns available for the skirting material.

SUMMARY OF THE INVENTION

The present invention however, provides a removably attachable flat sheet-skirting combination to enable anyone to install and/or to change the skirting material, after the flat sheet material is placed into position, on conventional beds and on waterbeds, which combination is designed to eliminate the above described problems by employing releasable fastening means on selected sites or areas of the skirting material and of the flat sheet material.

The flat sheet is fabricated from typically used conventional bedding fabrics which have good wear, strength and dimensional stability characteristics, especially after it has been placed or positioned into place. The flat sheet is further fabricated for use in the above combination, by preferably employing strips of flexible fastening material comprising a plurality of flexible hooks, found commercially as one part of a two part fastening system, which strips are permanently affixed by sewing and/or bonding to the peripheral areas of preferably at least two sides of the flat sheet and a t least one end of the flat sheet.

The skirting is fabricated from any available material which is desired by the manufacturer or the homemaker relative to color, pattern, thickness and the like. The skirting is Further Fabricated for use in the above combination, by preferably employing strips of flexible fastening material comprising a plurality of flexible loops, found commercially as the other part of the above mentioned two part fastening system, which strips are permanently affixed by sewing and/or bonding to the peripheral areas of preferably at least two sides of the skirting and at least one end of the skirting.

It is herein noted that the hooks and the loops of the above mentioned fastening system may be interchanged relative to their employment on either the flat sheet or the skirting.

By design, the flat sheet generally accommodates the size of the box spring of a conventional bed or the size of the flatboard of a waterbed. More specifically, the flat sheet is fabricated to size, preferaby to fit within the area defined by the beading commonly found on box springs of conventional beds and to fit within the area defining the flatboard of waterbeds, and to fit within cording found on box springs of waterbeds, some of which look similar in appearance to conventional box springs, which are found on some "soft-side" waterbeds. This is done for esthetic appearances when the skirting portion of the combination is not in use, and to restrain lateral movement of the flat sheet during its tenure between the box spring and the mattress of a conventional bed or between the platform and the bladder of a waterbed, although the weight of the mattress or the filled bladder, alone, is generally sufficient to maintain the stability of the flat sheet in its desired position. Additionally, this is done to preferably provide a "finished" look to the bed when the skirting is removably attached to the flat sheet, whereby the skirting is "bent" along its horizontal edge where its fastener is attached, to align with the fastener of the flat sheet, so that the skirting masks visibility of the flat sheet and its fastener and thereafter gently drapes vertically toward the floor.

When the fastening material at one edge of the skirting material is aligned with the fastening material at a corresponding edge of the flat sheet, for removable attachment or engagement of the skirting to the flat sheet, one merely has to press the fastening material of the skirting material against the fastening material of the flat sheet in a progressive manner while simultaneously aligning the fastening material of the skirting to the fastening material of the flat sheet, without substantial interference of the mattress or the bladder and without requiring superior strength or dexterity.

Likewise, when it is desirable to change or to clean the skirting material, one merely has to pull or tug the skirting material at an angle away from the flat sheet, without having to grapple with the mattress or bladder. And, if it is desirable to leave the skirting off the bed for a period of time, there is no problem as the flat sheet and its fastening material is generally hidden from view, or it can be tucked from view under the mattress or the bladder.

One advantage of the present invent/on is that the flat sheet-skirting combination can be easily and quickly assembled or disassembled, without having to wrestle with the mattress or the bladder, and without having to possess great strength or endurance or dexterity.

Another advantage of the present invention is that the flat sheet remains in place between the mattress and the box spring or between the bladder and the platform flatboard, out of view during use, and yet it is readily accessible.

Still another advantage of the present invention is that by fabricating the flat sheet to size, to fit wi thin the beading of a box spring or within the confines of the flatboard, one has an option to use or not to use a skirting to accessorize a bed or other structure suitable for receiving the flat sheet-skirting combination, as the fiat sheet is generally not viewable or it can be tucked out of view.

Yet another advantage of the present invention is that after the flat sheet is in place between the mattress and the box spring or between the bladder and the flatboard, one has the versatility of changing the colors, patterns or fabrics of the skirting employed to accessorize the structure, without having to remove a flat sheet which is normally permanently attached to a skirting, thereby reducing drudgery of change and reducing risk of injury to the one so making a change.

The present invention has proven to be well suited to longevity of operation, as the flat sheet sees little wear during use in combination with a skirting, or during changes of the skirting or during non-use. The present invention has also proven to be reliable in maintaining the stability or placement of the flat sheet and the desired drape of the skirting. Furthermore, the present invention has proven to be of benefit, especially once the flat sheet of the inventive combination is in place, by allowing flexibility for changing or cleaning the skirting without getting frustrated, tired or strained muscles and without requiring the assistance of another.

It is therefore an object of the present invention to provide a simple, removably attachable fiat sheet-skirting combination for use on conventional beds and waterbeds comprising a flat sheet having a first fastening material of a cooperative two-part fastening system attached thereto and a skirting of preferably continuous length having a second fastening material of a cooperative two-part fastening system attached thereto, and to eliminate a cumbersome chore, fatigue and strain generally anticipated via the use of a permanently attached flat sheet-skirting combination.

It is another object of the present invention to provide a removably attachable flat sheet-skirting combination which is durable and which remains dimensionally stable during use on conventional beds and waterbeds.

It is yet another object of the present invention to provide a removably attachable flat sheet-skirting combination for use on conventional beds and on waterbeds, which is easily and quickly installed and which allows skirting to be changed or removed without grappling with a cumbersome mattress or a heavy water bladder.

It is still another object of the present invention to provide a removably attachable flat sheet-skirting combination which produces a finished look relative to the drape of the skirting and relative to the non-visibility of the fastening material(s) when the combination is in use.

It is a further object of the present invention to provide a removably attachable flat sheet-skirting combination which is reliable, and which is economical and versatile to use especially when it is desirable to change the color or pattern or the type of fabric.

This invention makes possible the use of commercially available flexible fasteners in an environment which is normally devoid of fasteners especially flexible fasteners, and makes possible the availability of an economical and versatile skirting accessory for beds and other similar structures.

According to the present invention, the flexible fasteners on the removably attachable flat sheet-skirting combination allow the user to easily and quickly remove or replace the skirting, and more frequently, without struggle, since only the skirting is removed or changed and the flat sheet remains in place, thereby eliminating the need to flex muscles or to seek assistance of another to deal typically with the mattress.

One essential feature of the present invention is the use of interacting, hook-loop flexible fasteners, to produce the means for removably attaching the skirting material to the pre-positioned flat sheet.

Another essential feature of the present invention is the use of a flat sheet which is independent of and not permanently attached to the skirting, so that once the flat sheet is positioned, generally between a mattress and a box spring or other spring means of a conventional bed or between a bladder and a flatboard of a waterbed, the skirting may be easily and quickly and effortlessly attached and removed from the flat sheet without having to wrestle or grapple with the mattress or bladder.

DETAILED DESCRIPTION OF THE PREFERRED EMBODIMENT

Figure 1:
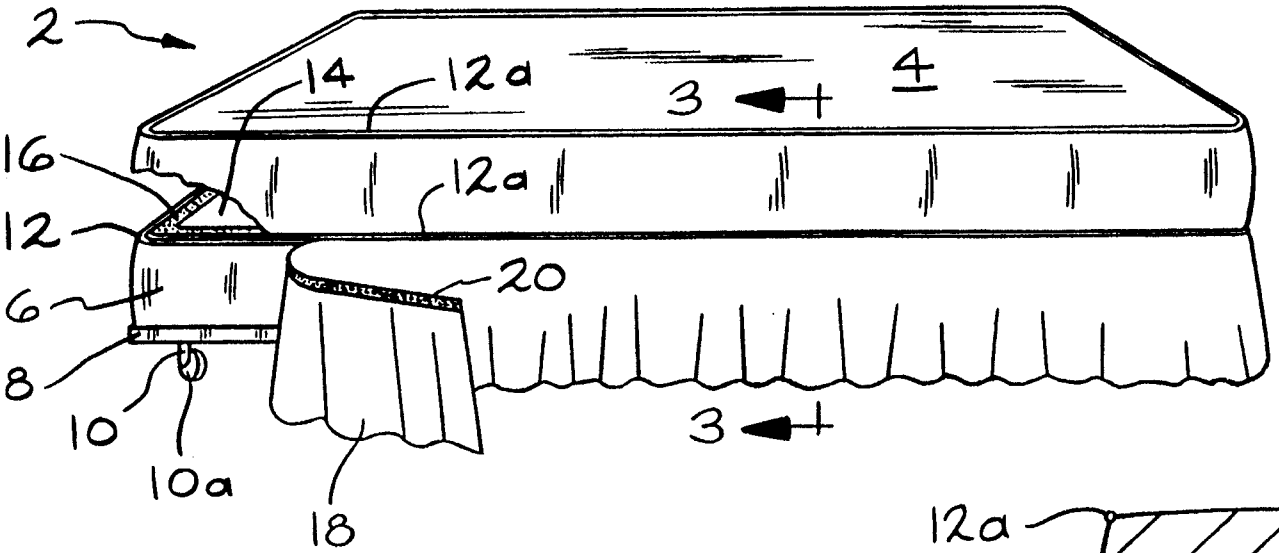
FIG. 1 is a side view in perspective of a conventional bed with a partial cut-away to show a removably attachable flat sheet-skirting combination in a state of partial disassembly.

The removably attachable flat sheet-skirting combination of this invention finds particular utility when accessorizing bedding structures, including conventional beds, spring surface-metal frame beds and waterbeds, which generally comprise a box spring or spring surface or flatboard respectively, to support a heavy, cumbersome mattress or bladder filled with water.

Specifically, the removably attachable flat sheet-skirting combination of this invention finds utility on beds by enabling the user of the combination to attach and/or to remove skirting quickly and effortlessly and to adjust the drape of the skirting uniformly relative to the flooring and to preferably cover from view the flat sheet of the combination to provide a finished look to such structures.

In the construction of the removably attachable flat sheet-skirting combination, it is important to employ coacting flexible fasteners with the flat sheet and with the skirting which are capable of holding a load or hanging weight of fabric without unwanted separation or sagging and which is capable of being pulled apart when desired in a quick and easy manner. At the same time, it is important that such fasteners be easily reachable by the user of the combination to allow for effortless attachment or removal of the skirting to/from the flat sheet, without having to wrestle or grapple with a mattress or a bladder filled with water.

These requirements indicate the necessity for providing measured dimensions or areas to the flat sheet which preferably are slightly less or approximately equal to the specific dimensions or areas of the box springs or spring surfaces or flatboards for various sizes of beds, e.g. King, Queen, Regular, Hollywood, Bunk, and the like, so that the flat sheet and its flexible fastener preferably lie in a plane generally parallel to the top surface of a box spring or a spring surface or a flatboard, to provide means for receiving the coacting fastener on the skirting, on such plane, thereby hiding from view both fasteners and allowing the skirting to gently drape for a finished look. However, in some instances, it may be desirable or necessary to allow the flexible fastener on the flat sheet to extend beyond the dimensions or boundaries of the box spring or the spring surface or the flatboard and to angle downwardly, even approaching the perpendicular relative to the flooring, so that the removably attachable flat sheet-skirting combination can be utilized on a particular structure. Likewise, the above requirements indicate the necessity for providing measured dimensions or areas for the skirting material, comprising various colors, patterns and fabrics, to generally coincide with the lengths and widths of the box springs or the spring surfaces or the flatboards of the various sized beds, and to generally coincide with the heights generated from their top or upper surfaces relative to the flooring, to provide a finished look. Therefore, it is essential that the flat sheet with its fastener and the skirting with its fastener be properly dimensioned for use with a particular sized bed and/or with a particular construction of bed, to realize the benefits of this simple yet unique combination.

Referring to FIG. 1, a conventional bed 2 is shown comprising a mattress 4 juxtaposed on a box spring 6, both of which are supported by a frame 8, generally constructed from wood or metal, resting on legs 10 which are pictured attached to casters 10*a*, or wheels. The partial cut-away of the mattress 4, in FIG. 1, shows a flat sheet 14 comprising a first flexible fastening material 16, of the hook and loop variety, attached thereto by sewing or bonding, which is one part of a two part fastening system, commercially available as VELCRO. The flat sheet 14 is positioned between the mattress 4 and the box spring 6, and as it lies upon the upper surface of the box spring 6, the first fastening material 16 preferably lies in approximately the same plane as the upper surface of the box spring 6 and within cording 12 which typically borders most box spring structures. As the mattress 4 is placed on top of the flat sheet 14 and its flexible fastening material 16, the cording 12*a* of the mattress 4 is visible, but the flat sheet 14 and its flexible fastener 16 are generally covered from view. A skirting material 18 comprising a second flexible fastening material 20, of the hook and loop variety, attached thereto by sewing or by bonding, which is the other part of the above referenced two part system, is removably attachable to the flat sheet 14 by merely positioning the sheeting material 18 along side the box spring 6, generally at the head of the bed 2, and aligning the second fastening material 20 with the first fastening material 16 and gently pressing the fastening materials 16, 20 together and repeating such action in a sliding motion along the length of the skirting material 18.

The resulting removably attachable flat sheet-skirting combination provides a finished look to the bed 2 as time skirting material 18 covers from view both fastening materials 16, 20 and the flat sheet 14 and the box spring 6 and the frame 8, legs 10 and casters 10*a*, as it gently drapes to the flooring. Only the mattress 4 and its cording 12*a* are visible, yet when sheeting is employed, they also will be covered from view. The skirting material 18 is easily removed by tugging it at an angle to the flat sheet 14, whereby the fastening materials 16, 20 separate and the flat sheet 14 remains undisturbed and ready to receive another skirting material of different color, pattern or fabric or to receive the skirting material which was removed for cleaning.

Referring again to FIG. 1, generally, the first fastening material 16 is attached to the periphery of the fiat sheet 14, and the second fastening material 20 is attached to the upper edge of the skirting 18, whereby upon positioning the skirting 18 and aligning the fasteners 16, 20 a drape of uniform height is assured. The first fastening material 16 is preferred to be of continuous length along the periphery of at least one length or one width of the flat sheet 14 and preferably along two lengths and one width thereof. And, occasionally the entire periphery of the flat sheet. 14 has attached thereto the first fastening material 16, when it is desirable to have the skirting material 18 completely surround the bed 2, for example when the bed 2 is positioned in a room with all of its sides open to view.

The skirting material 18 is generally of a continuous length, preferably of a length to continuously drape about two lengths and one width of the box spring 6 to produce a finished look similar to existing permanently attached flat sheet-skirting combinations, but without the fuss of having to wrestle with the mattress 4. Due to the particular construction of a bed, for example, when posts are employed, such as a poster bed or a bunk bed, not shown in the drawings for a conventional bed, the continuous lengths of skirting material 18 will be limited to the length or the width of the box spring 6 or of a spring surface when employed, and the drape of the skirting material 18 will be interrupted by such posts. Thereby, separate lengths and widths of skirting material 18 are employed and are removably attachable to the flat sheet 14 to provide a finished look, and these separate lengths and widths of skirting material 18 may be employed on bed 2 even when no posts are present. And, under circumstances where a bed 2 is positioned in a room whereby all four sides are visible, the skirting material 18 can be of a continuous length to completely cover all four sides of the box spring 6, frame 8, legs 10 and coasters 10*a*, to provide a finished look.

Figure 2:
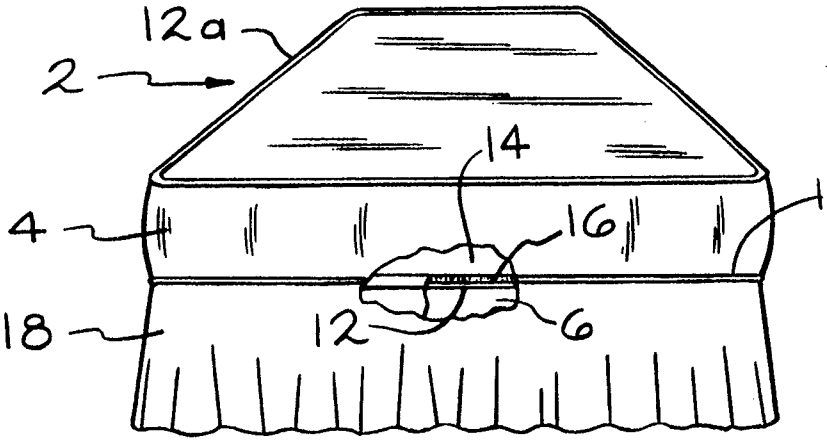
FIG. 2 is an end view in perspective of a conventional bed with a partial cut-away to show a removably attachable flat sheet-skirting combination in a state of assembly.

Referring to FIG. 2, the removably attachable flat sheet-skirting combination is shown is a state of assembly on a conventional bed 2, and the partial cut-away of mattress 4 and skirting 18 allows a clearer representation of how the skirting 18, at its upper edge, is tucked under the mattress 4 to be received by the flat sheet 14 and its flexible fastener 16, all of which are sandwiched between the mattress 4 and the box spring 6, whereby a finished look is produced with ease, quickness and minimal effort. The first fastening material 16 attached to the flat sheet 14 is preferably on the same plane as the planes of the lower side of the mattress 4 and the upper side of the box spring 6 and lies approximately adjacent to and preferably within the boundaries of the cording 12 of the box spring 6, which cording 12 is generally located on the periphery of the box spring 6, whereby only the cording 12*a* on the periphery of the upper and lower surfaces of the mattress 4 is visible after the assembly of the removably attachable flat sheet-skirting combination, and usually a sheet and/or other accessories cover such cording 12*a*.

Figure 3:
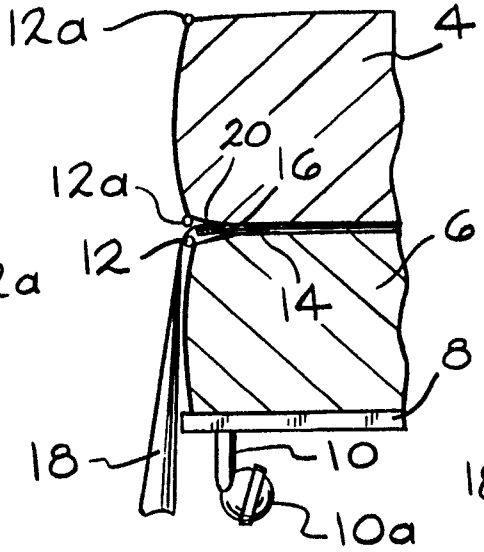
FIG. 3 is a partial sectional view taken along line 3—3 of FIG. 1.

Another representation of the preferred embodiment of this invention is shown in FIG. 3, which is a partial sectional view taken along line 3—3 of FIG. 1, whereby the flat sheet 14 and its fastening material 16 are sandwiched between mattress 4 and box spring 6, both of which are supported by frame 8 having legs 10 and casters or wheels 10*a*. The first fastening material 16 attached to flat sheet 14 lies within beading 12 of box spring 6 and the second fastening material 20 of skirting 18 is aligned with and joined with such first fastening material 16, whereby the skirting 18 develops a gentle bend at its upper edge prior to draping to the flooring. Only the cording 12*a* on the periphery of the upper and lower surfaces of mattress 4 are visible when the removably attachable flat sheet-skirting combination is assembled, and as stated above such cording 12*a* is generally covered by other bedding accessories.

Adjustment of the height of skirting 18 relative to the flooring may be made to compensate for varying distances from the first fastening material 16 to the flooring, be it hardwood surfaces or different types of pile-carpeting, by simply aligning the second fastening material 20 inwardly or outwardly relative to the first fastening material 16, as the fastening materials 16, 20 do not have to be perfectly matched, as shown in FIG. 3, to support the load or weight of the skirting 18.

Figure 4:
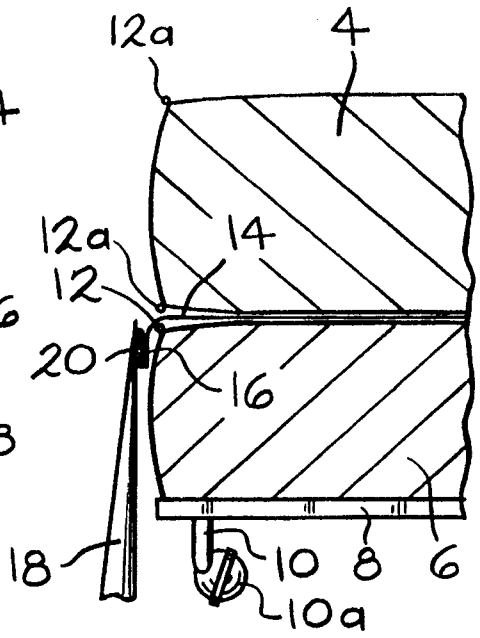
FIG. 4 is an alternate construction of that shown in FIG. 3.

An alternate embodiment or construction of the removably attachable flat sheet-skirting combination of this invention is represented in FIG. 4, which shows the flat sheet 14, sandwiched between the mattress 4 and the box spring 6, which are supported by frame 8, legs 10 and casters or wheels 10*a*, wherein the periphery of the flat sheet 14 and the first flexible fastener 16 extends beyond the confines of the cording 12 on the upper surface of the box spring 6. When the first flexible fastener 16 extends a short distance beyond the cording 12 it generally lies within the approximate plane of the flat sheet 14, but when it extends a greater distance beyond the cording 12, it generally lies at an angle to the plane of the flat sheet 14, which angle can be any angle and reach and exceed perpendicular, as shown. This construction allows the flexible fastener 20 of the skirting material 18 to be removably attachable to the flexible fastener 16 on the flat sheet 14, without having to insert the upper edge of the skirting material 18 into the gap generally formed by the mattress 4 and the box spring 6.

Referring again to FIG. 4, when the angle of the first fastening material 16 approaches or exceeds perpendicular to the flat sheet 14, as shown, it is preferable to have the skirting material 18 extend beyond the second fastening material 20 to provide a finished look, whereby the cording 12 on box spring 6 and the flat sheet 14 is concealed from view. The flexible fastening material 20 on the skirting material 18 is shown to be wider than the flexible fastening material 16 on flat sheet 14, as their widths do not necessarily have to be tile same, and the larger width can as easily reside with flexible fastener 16, whereby in either case, added flexibility of adjustment of the height of skirting 18 is available. When the angle of the first fastening material 16 is substantially less than perpendicular to the flat sheet 14, the skirting material 18 need not be preferentially extended beyond the second fastening material 20 since the upper area of the skirting material 18 will be gently bent to match the angle of the first fastening material 16, not shown, whereby the cording 12 on box spring 6 and the flat sheet 14 will be concealed from view to provide a finished look. Only the cording **12*a* on mattress 4** will be visible, but that is usually covered by other accessories such as sheets and blankets.

Figure 5:
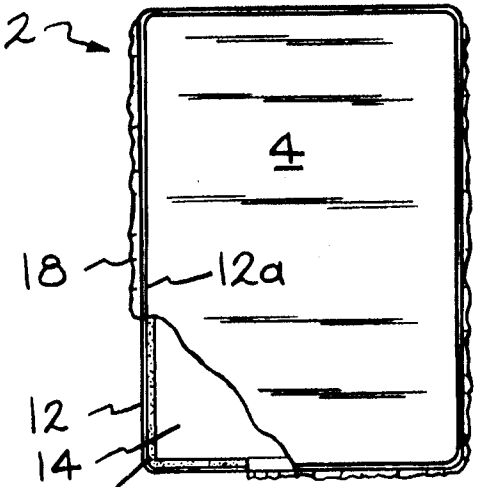
FIG. 5 is a top plan view of a conventional bed with a partial cut-away to show a removably attachable flat sheet-skirting combination in a state of assembly.

Referring to FIG. 5, the removably attachable flat sheet-skirting combination of this invention is shown in full assembly about three sides of a conventional bed 2, wherein the skirting material 18 is one continuous length. A partial cut-away of mattress 4 and skirting material 18 shows another view of the preferred embodiment, whereby the flat sheet 14 and the first fastening material 16 lie generally on the same plane and within cording 12, and only cording **12*a* on mattress 4 is visible. It is noted that when sheets and other linen are added to or removed from the mattress 4, the bond between the fasteners is not disturbed. And, the flat sheet 14, after being positioned between mattress 4 and box spring 6**, generally stays in place during use over extended periods.

Figure 6:
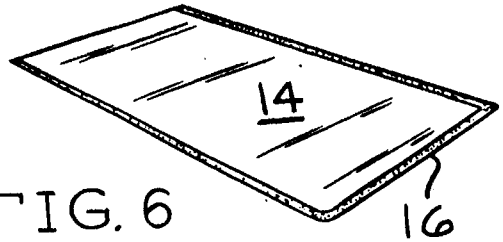
FIG. 6 is a perspective view of a flat sheeting material with its fastening material attached thereto in a planar relationship.
Figure 7:
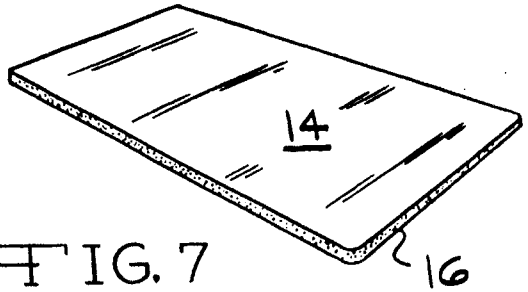
FIG. 7 is a perspective view of a flat sheeting material with its fastening material attached thereto in an angled relationship.

Referring to FIG. 6 and to FIG. 7, the flat sheet 14 and its flexible fastener 16 are shown to more clearly described the preferred embodiment and an alternate embodiment, respectively. Specifically, FIG. 6 shows the first fastening material 16 to be a continuous strip about the periphery of three sides of the flat sheet 14 and within the same plane as the flat sheet 14, while FIG. 7 shows the first fastening material 16 to be a continuous strip about the periphery of two sides of the flat sheet 14 and at an angle to the flat sheet 14.

It is noted that while a continuous strip of fastening material 16 is preferred for attachment onto the flat sheet 14 along the periphery of at least one edge of the flat sheet 14, that discontinuous lengths of fastening material 16 can be employed to provide a continuous effect or to provide spaced apart areas for attachment of the second fastening material 20 attached to skirting 18.

When waterbeds were accessorized with the removably attachable flat sheet-skirting combination, various construction differences, departing from conventional beds, had to be addressed, as seen from the discussion below.

Figure 8:
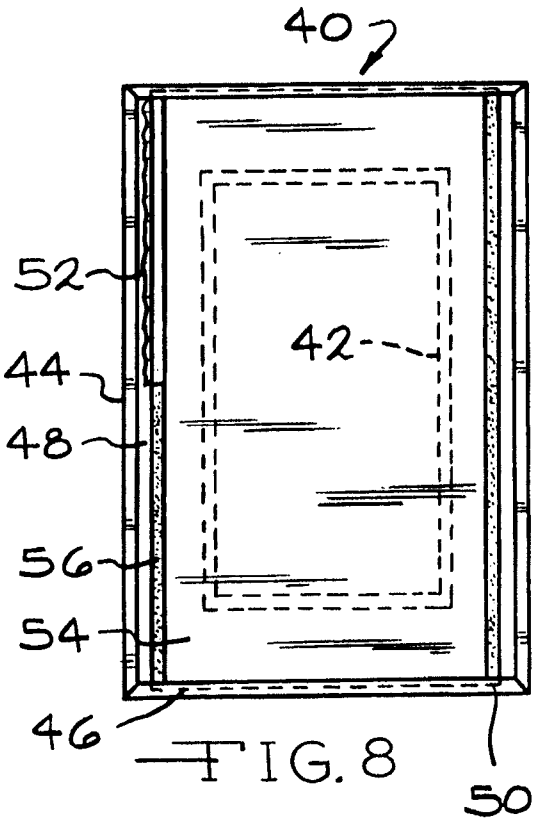
FIG. 8 is a top plan view of a conventional waterbed structure, without a bladder, showing spacial relationships of its elements, with a flat sheeting material and its fastening material positioned to receive a removably attachable skirting material.

Referring to FIG. 8, waterbed 40 is shown via a top plan view to be constructed from elements comprising a platform 42 or kickboard, a frame 44, which is suspended and stabilized by a flatboard 46 via tongue-groove relationships 50, whereby the flatboard 46 rests upon platform 42. Generally, the tongue-groove relationships 50 are found to be located at the ends of the waterbed 40, whereby sufficient space 48 is provided along the sides of the waterbed 40, between the frame 44 and the flatboard 46, to allow the removably attachable flat sheet-skirting combination to be employed. No water bladder is shown in FIG. 8, so that the flat sheeting material 54 with its flexible fastening material 56 can be easily seen, positioned on top of the flatboard 46 and covering the exposed area of the flatboard 46, whereby separate continuous lengths of fastening material 56 are attached along the sides of the flat sheet 54. When the space 48, defined by the frame 44 and the flatboard 46, along the sides of the waterbed 40, are substantial enough to receive a skirting material 52 by introduction of the skirting material 52 through the space 48, the preferred embodiment of the flat sheet 54 and its fastening material 56, both being in the same plane, can be employed, as shown. However, when the space 48 is not substantial enough to receive a skirting material 52 by introduction of the skirting material 52 through the space 48, an alternate embodiment, not shown, of the flat sheet 54 and its fastening material 56 can be employed, whereby the flat sheet 54 and its fastening material 56 are extended beyond the sides of the flatboard 46 and fed through the space 48, for reception of the skirting material 52.

Figure 9:
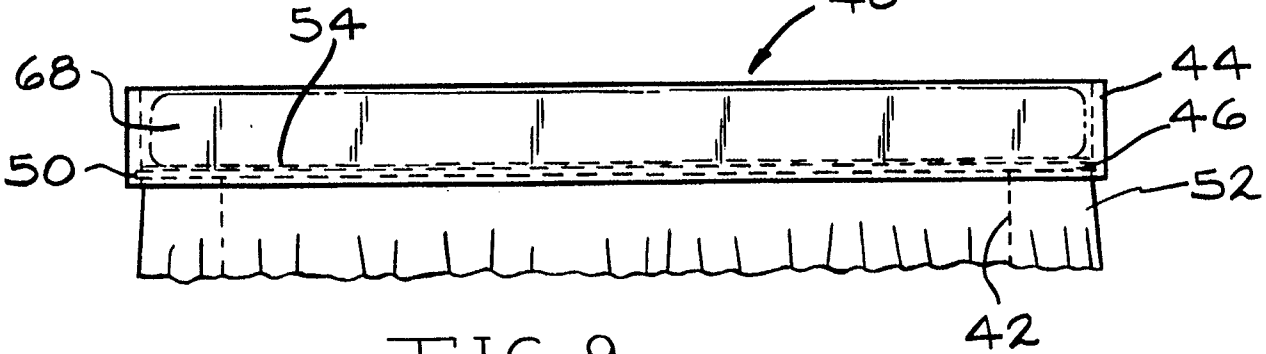
FIG. 9 is a side elevation view of a conventional waterbed structure with a bladder, showing a skirting material draping downwardly from such structure.

Referring to FIG. 9, a waterbed 40 is shown in a side elevation view to more clearly show the flatboard 46 resting upon the platform or kickboard 42 and the tongue-groove relationship 50 between the flatboard 46 and the frame 44 at the ends of the waterbed 40. A water bladder 68 is shown in phantom, being supported by the flatboard 46, with flat sheet 54 being sandwiched therebetween for reception of the skirting material 52, to provide a finished look to the waterbed 40.

Figure 10:
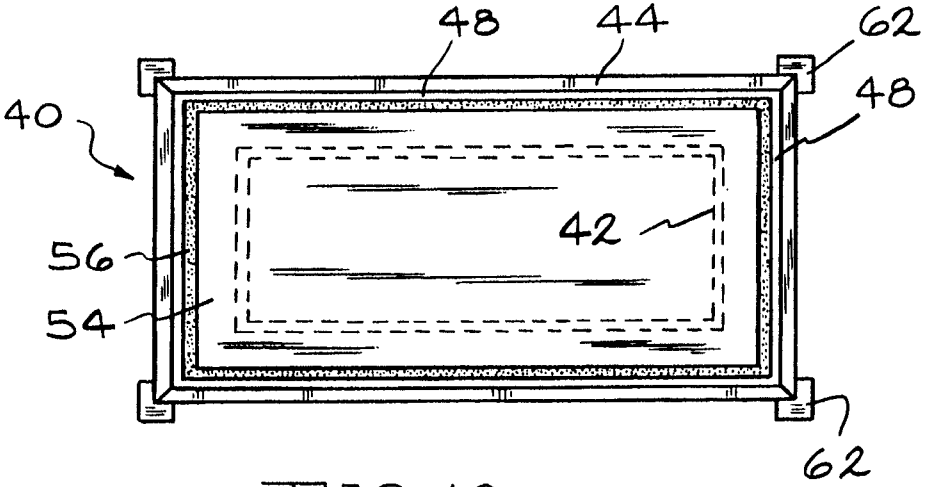
FIG. 10 is a top plan view of a four-post waterbed structure, without a bladder, showing spacial relationships of its elements, with a flat sheeting material and its fastening material positioned to receive a removably attachable skirting material.

Referring to FIG. 10, a top plan view of a four-post waterbed 40, without a water bladder, is shown to demonstrate the availability of use of the removably attachable flat sheet-skirting combination therewith. Instead of a tongue-groove construction being employed to suspend and to stabilize the frame 44, posts 62 are attached to the frame 44 to suspend and to stabilize it during use. This type of construction provides for space 48 on all sides of the flatboard, which is shown to be covered by flat sheet 54 and its fastening material 56 in the preferred embodiment, since sufficient space is generally provided with four-post construction to introduce a skirting material through the space 48 for reception by the fastening material 56.

Figure 11:
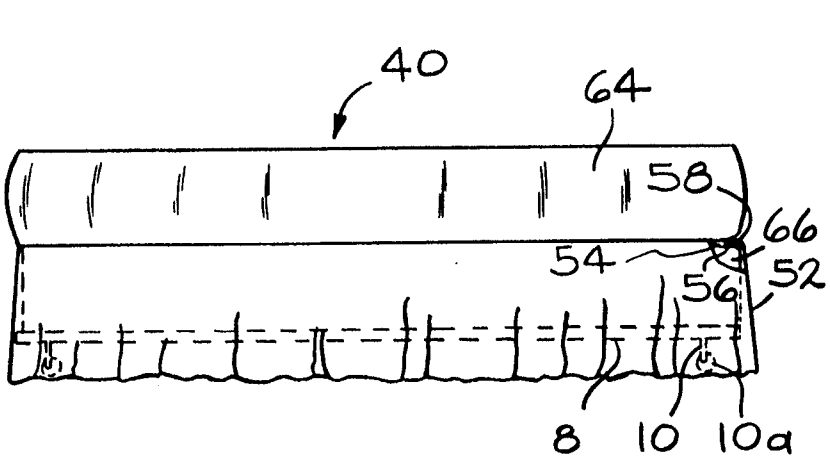
FIG. 11 is a side elevation view of a soft-side waterbed structure, with a partial cut-away to show the relationship of a removably attachable flat sheet-skirting combination therewith.

Referring to FIG. 11, a side elevation of a soft-side waterbed 40 is shown with a partial cut-away to show how its elements and their resemblance to a conventional bed allow the use of the preferred embodiment of the removably attachable flat sheet-skirting combination therewith. Specifically, soft-side water mattress 64 is shown resting upon box spring 66, both of which are supported by frame 8, legs 10 and casters or wheels **10*a***.

The soft-side water mattress 64 is constructed in such manner that it is self supporting and does not require a frame to confine it, as is case with a water bladder as discussed above. Thereby, the removably attachable flat sheet-skirting combination is readily employable with the soft-side waterbed 50, by positioning the flat sheeting material 54 and its flexible fastening material 56 between the soft-side water mattress 64 and the bed spring 66, preferably having the flat sheeting material 54 and its flexible fastening material 56 on the approximate same plane as the lower surface of the soft-side mattress 64 and the upper surface of the box spring 66. A simple alignment of the flexible fastening material 58 attached to the upper area of the skirting material 52 and a sliding pressure applied to the fastening materials 56, 58 will assure a secure bond and allow the skirting material 58 to drape downwardly at a predetermined distance from the flooring for a pleasant finished look.

Some constructions of waterbeds, generally those employing a frame suspended and stabilized by a tongue-groove relationship with a flatboard, usually at its ends, which frame and flatboard support a water bladder, restrict the use of the removably attachable flat sheet-skirting combination at either end of such waterbeds, such as those described in FIG. 8 and FIG. 9. However, an adjunct use of the removably attachable flat sheet-skirting combination can be employed in yet another embodiment to provide a skirting material at the ends of such waterbeds.

Figure 12:
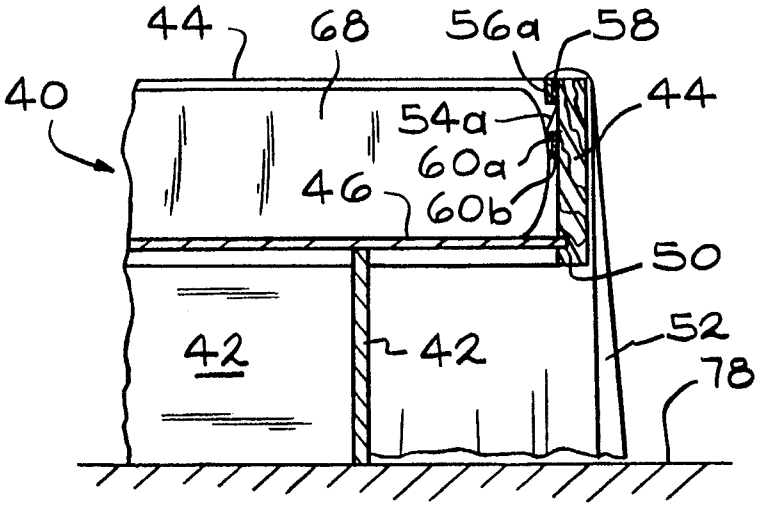
FIG. 12 is a cross-sectional side view of a conventional waterbed structure, with portions in elevation, showing an alternate construction of the removably attachable fiat sheet-skirting combination.

Referring to FIG. 12, a conventional waterbed structure 40 is shown in a cross-sectional side view, with portions in elevation, to demonstrate an adjunct use of the removably attachable flat sheet-skirting combination, since the tongue-groove relationship 50 between the flatboard 46 and the frame 44 prevents access to a flat sheet and its fastening material (not shown) which normally is sandwiched between the water bladder 68 and the flatboard 46. The flatboard 46, the frame 44 and the water bladder 68 are supported by platform or kickstand 42 which rests upon the flooring 78. Most frames 44 of a waterbed 40 are acceptable in appearance, but when it is desirable to employ a skirting material 52 to cover the same, especially at the one end or the foot of the waterbed 40, the adjunct use of the removably attachable flat sheet-skirting combination is employed. Specifically, a flat sheet **54*a* having a first flexible fastening material 56*a* attached to the periphery of its outside upper surface for reception of the second flexible fastening material 58 on skirting material 52, has a third flexible fastening material 60*a* attached to the periphery of its inside lower surface for reception by a fourth flexible fastening material 60*b* which is joined or attached by adhesive or other means to the inside surface of the frame 44. With such construction, the fastening material 60*b* is generally located on the inside surface of frame 44 so that it preferably is out of view yet accessible for attachment by the fastening material 60*a*, and both fastening materials 60*a*, 60*b* are preferably in strip form. When the skirting 52 is removed for any period of time, the flat sheet 54*a* and its fasteners 56*a*, 60*a* may be completely removed from fastener 60*b* or it may be tucked out of view between frame 44 and water bladder 68. Flat sheet 54*a* is shown to be relatively short and within the confines of the inside surface of the frame 44, but it can extend onto the top or onto the outside surface of the frame 44 or even below the dimension of the outside surface of the frame 44, prior to receiving skirting 52 via its Fastener 58**.

This adjunct use of the removably attachable flat sheet-skirting combination can also be employed on the sides of a waterbed when, in some instances, insufficient space or no space is provided by the manufacturer between the flatboard and the frame of the waterbed. The skirting 52 provides a finished look to the waterbed 40 when the frame 44 is covered by the adjunct use of the removably attachable flat sheet-skirting combination, since it drapes relatively evenly to the flooring 78 and since all the fasteners **56*a*, 58, 60*a*, 60*b*** are covered from view.

When the construction of a waterbed is such that a tongue-groove relationship exists between the flatboard and the frame and/or insufficient or no space exists between the flatboard arid the frame for access to the flat sheet and its fastener by the skirting and its fastener, as described previously in the preferred and alternate embodiments, the flat sheet can be substantially extended (not shown) in yet another alternate embodiment, so that it is accessible by pulling it upward from the flatboard between the water bladder and the frame.

Figure 13:
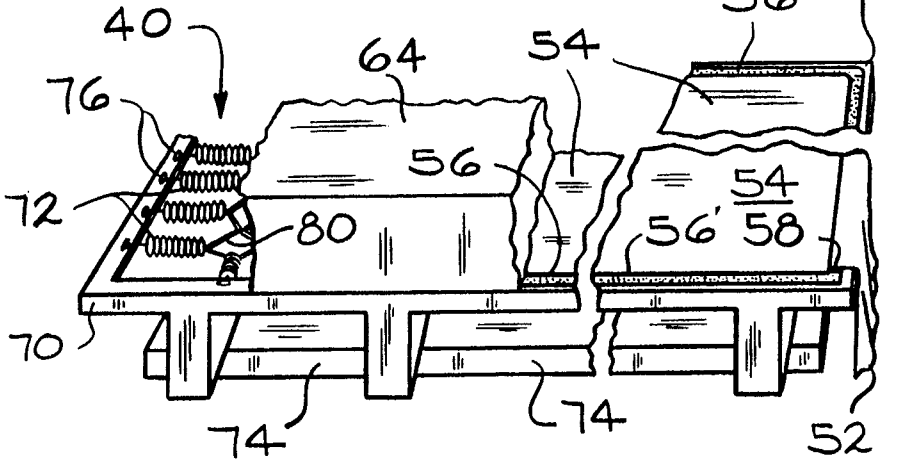
FIG. 13 is a fragmentary view in perspective of a waterbed structure to show a spring surface-frame assembly supporting a soft side water mattress, and to show the accessibility from all sides of a flat sheeting material and its fastening material for reception of a removably attachable skirting material.

Referring to FIG. 13, a relatively new construction for a waterbed 40 has been put on the market which employs the use of elements of conventional beds to support a soft-side mattress 64, thereby making available the use of the preferred embodiment of the removably attachable flat sheet-skirting combination therewith. A metal frame 70 is shown resting upon a base 74 and along the inside periphery of the metal frame 70 there are a plurality of uniformly spaced holes 76 for reception of spring coils 72 attached to a lattice-work of metal wire 80 to produce a taught spring surface sufficient to support a soft-side mattress 64. Placement of a flat sheet 54 with its continuous strip of flexible fastening material 56 attached thereto on the same approximate plane defined between the spring surface and the soft-side mattress 64, makes available the flexible fastening material 56, out of view but easily accessible, for reception of the skirting material 52 via its flexible fastening material 58 to provide a finished look to waterbed 40.

Modifications of the disclosed combination may be resorted to without departing from the spirit and scope of the appended claims.

I claim:

1. A removably attachable flat sheet-skirting combination for a conventional bed, said bed comprising a frame, a box spring and a mattress, and said combination further comprising:

(a) A flat sheet adapted to fit between said box spring and said mattress of said bed, said flat sheet comprising peripheral areas and a top side and a bottom side and said flat sheet further comprising surface dimensions which substantially coincide with upper surface dimensions of said box spring;

(b) A first strip of fastening material comprising a plurality of flexible hooks, said first strip being adhered to said top side of said flat sheet at said peripheral areas;

(c) A skirting material adapted for quick and effortless attachment to and removal from said flat sheet and being of sufficient length to cover at least two sides of said box spring and said frame, said skirting material comprising an upper edge, a lower edge, an inside surface and an outside surface of sufficient height to allow close proximity of said lower edge of said skirting material to flooring upon which said conventional bed rests;

(d) A second strip of fastening material designed for releaseable cooperation with said first strip, said second strip comprising a plurality of flexible loops adhered to said inside surface of said skirting material at substantially said upper edge of said skirting material;

whereby upon positioning said flat sheet between said box spring and said mattress, with said bottom side of said flat sheet resting upon said box spring, and upon aligning and contacting said second strip of said skirting material with said first strip of said flat sheet, said skirting material becomes securely attached to said flat sheet and said skirting material drapes downwardly to cover said box spring and said frame and said outside surface provides decorative and aesthetic features, and whereby said skirting material is readily removable from said flat sheet for cleaning and/or for replacement without having to remove said flat sheet from between said box spring and said mattress, by merely tugging said skirting material at an angle away from said flat sheet.

2. A combination as set forth in claim 1, wherein said first and second strips comprise substantially the same width, to provide a reference for accurate positioning of said skirting material at said lower edge relative to said flooring.

3. A combination as set forth in claim 1, wherein said second strip adhered to said skirting material is wider than said first strip adhered to said flat sheet, to provide a substantial margin of flexibility of height adjustment of said skirting material relative to said flooring.

4. A combination as set forth in claim 1, wherein said first and said second strips of fastening material are of substantially continuous length to allow for continuous adherence of said skirting material to said flat sheet along at least two sides of said bed.

5. A combination as set forth in claim 1, wherein said first and second strips of fastening material are substantially continuous except for discontinuous areas in at least two adjacent corners of said flat sheet for accommodation of said skirting material between bed posts projecting upwardly from said frame of said bed.

6. A combination as set forth in claim 1, wherein said flat sheet comprises a surface area substantially less than said upper surface dimensions of said box spring, to allow said flat sheet to lay within cording running along said upper surface dimensions of said box spring.

7. A combination as set forth in claim 6, wherein said flat sheet surface area lies in a plane substantially horizontal and parallel to said upper surface dimensions of said box spring, to allow said second strip on said skirting material to be removably attachable in said plane to said first strip on said flat sheet, whereby said skirting material covers said flat sheet from view, and said mattress covers said upper edge of said skirting material, and said horizontal attachment of said first and second fastening strips imparts a gentle bend to said skirting material prior to said skirting material draping in a substantially vertical plane to said flooring.

8. A combination as set forth in claim 1, wherein said flat sheet comprises a surface area substantially larger than said upper surface dimensions of said box spring, to allow said first strip on said flat sheet to extend beyond cording running along said upper surface dimensions of said box spring.

9. A combination as set forth in claim 8, wherein substantially all of said flat sheet surface area lies in a plane substantially horizontal and parallel to said upper surface area of said box spring, except for that portion of said flat sheet and said first fastening strip which extend beyond said cording on said box spring and hangs downwardly at an angle approaching and including perpendicular to said flooring, to allow said second strip on said skirting material to be removably attachable at said angle to said first strip on said flat sheet, whereby said skirting material covers said flat sheet from view and said angle of said first and second fastening strips imparts a corresponding angle to said skirting material prior to said skirting material draping in a substantially vertical plane to said flooring.

10. A removably attachable flat sheet-skirting combination for a frame bed, said bed comprising a metal frame, a spring surface and a mattress or a water bladder, and said combination further comprising:

(a) A flat sheet adapted to fit between said spring surface and said mattress or said water bladder of said frame bed, said flat sheet comprising peripheral areas and a top side and a bottom side and said flat sheet further comprising surface dimensions which substantially coincide with interior surface dimensions of said metal frame;

(b) A first strip of fastening material comprising a plurality of flexible hooks, said first strip being adhered to said top side of said flat sheet at said peripheral areas;

(c) A skirting material adapted for quick and effortless attachment to and removal from said flat sheet and being of sufficient length to cover at least two sides of said spring surface and said frame, said skirting material comprising an upper edge, a lower edge, an inside surface and an outside surface of sufficient height to allow close proximity of said lower edge of said skirting material to flooring upon which said metal frame bed rests;

(d) A second strip of fastening material designed for releaseable cooperation with said first strip, said second strip comprising a plurality of flexible loops adhered to said inside surface of said skirting material at substantially said upper edge of said skirting material;

whereby upon positioning said flat sheet between said spring surface and said mattress or said water bladder with said bottom side of said flat sheet resting upon said interior surface dimensions of said metal frame, and upon aligning and contracting said second strip of said skirting material with said first strip of said flat sheet, said skirting material becomes securely attached to said flat sheet and said skirting material drapes downwardly to cover said spring surface and said frame and said outside surface provides decorative and aesthetic features, and whereby said skirting material is readily removable from said flat sheet for cleaning and/or for replacement without having to remove said flat sheet from between said spring surface and said mattress or said water bladder, by merely tugging said skirting material at an angle away from said flat sheet.

11. A combination as set forth in claim 10, wherein said first and second strips comprise substantially the same width, to provide a reference for accurate positioning of said skirting material at said lower edge relative to said flooring.

12. A combination as set forth in claim 10, wherein said second strip adhered to said skirting material is wider than said first strip adhered to said flat sheet, to provide a substantial margin of flexibility of height 26. A combination as set forth in claim 19, wherein said flat sheet comprises a surface area substantially larger than said upper surface dimensions of said flatboard, to allow said first strip on said flat sheet to extend beyond exterior surface dimensions of said flatboard.

27. A combination as set forth in claim 26, wherein substantially all of said flat sheet surface area lies in a plane substantially horizontal and parallel to said upper surface area of said flatboard, except for that portion of said flat sheet and said first fastening strip which extends beyond said flatboard and hangs downwardly through a space provided between said flatboard and said frame at an angle approaching and including perpendicular to said flooring, to allow said second strip on said skirting material to be removably attachable at said angle to said first strip on said flat sheet, whereby said skirting material covers said flat sheet from view and said angle of said first and second fastening strips imparts a corresponding angle to said skirting material prior to said skirting material draping in a substantially vertical plane to said flooring.

* * * * *